United States Patent [19]

Steiner

[11] 4,082,519

[45] Apr. 4, 1978

[54] PROCESS FOR THE GASIFICATION OF COAL

[75] Inventor: Peter Steiner, Edison, N.J.

[73] Assignee: Foster Wheeler Energy Corporation, Livingston, N.J.

[21] Appl. No.: 700,945

[22] Filed: Jun. 29, 1976

Related U.S. Application Data

[63] Continuation of Ser. No. 395,087, Sep. 7, 1973, abandoned.

[51] Int. Cl.[2] ..... C10J 3/06

[52] U.S. Cl. ..... 48/202; 48/210

[58] Field of Search ..... 166/260, 261; 48/202, 48/206, 210; 423/415, 539, 569, 648, 563

[56] References Cited

U.S. PATENT DOCUMENTS

| | | | |
|---|---|---|---|
| 871,912 | 11/1907 | Carpenter | 423/569 |
| 1,407,323 | 2/1922 | Browning | 423/563 |
| 1,678,630 | 7/1928 | Bahr | 423/539 |
| 1,734,991 | 11/1929 | Bacon | 423/569 |
| 1,842,230 | 1/1932 | Bacon | 423/569 |
| 1,908,873 | 5/1933 | Tyrer | 423/569 |
| 2,134,548 | 10/1938 | Danulat | 48/206 |
| 2,539,466 | 1/1951 | Parry | 48/202 X |
| 2,739,105 | 3/1956 | Ford et al. | 201/36 |
| 3,688,438 | 9/1972 | Slater et al. | 48/202 X |

FOREIGN PATENT DOCUMENTS

| | | | |
|---|---|---|---|
| 139,421 | 10/1948 | Australia | 423/563 |
| 701,232 | 12/1940 | Germany. | |
| 158,288 | 2/1921 | United Kingdom | 423/563 |
| 358,558 | 10/1931 | United Kingdom | 423/563 |

OTHER PUBLICATIONS

"Gasification of Char with Sulfur Dioxide," Kertamus et al., 166th ACS meeting, Aug. 27-31, 1973, Chicago, Illinois.

"Inorganic and Theoretical Chemistry", Mellor, pp. 16 and 22, vol. X, 1930.

*Primary Examiner*—S. Leon Bashore
*Assistant Examiner*—Peter F. Kratz
*Attorney, Agent, or Firm*—Marvin A. Naigur; John E. Wilson

[57] ABSTRACT

Continuous process for the gasification of particulate coal with steam wherein $SO_2$ is present, preferably through introduction into the steam, thereby enabling the steam to react with the coal at considerably lower than conventional temperatures such as temperatures ranging upwards of 1200° F, preferably 1400° F.

4 Claims, 1 Drawing Figure

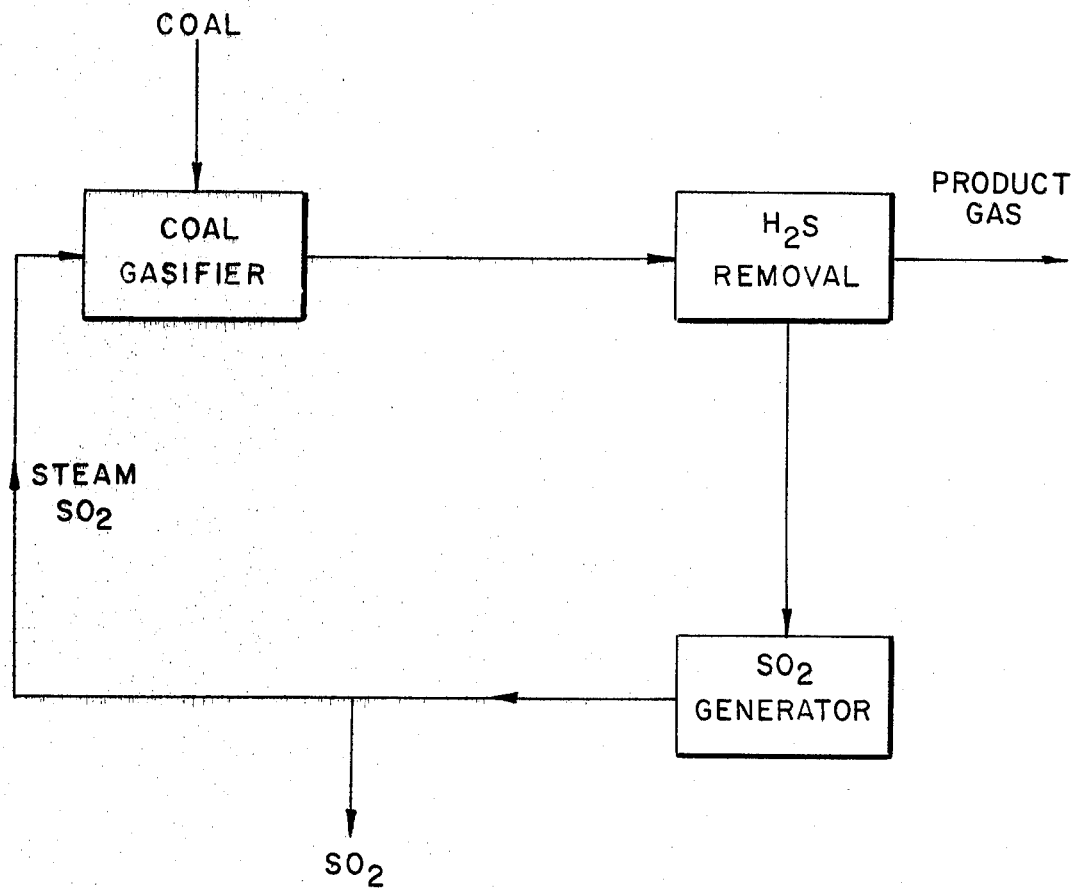
COAL
COAL GASIFIER
$H_2S$ REMOVAL
PRODUCT GAS
STEAM
$SO_2$
$SO_2$ GENERATOR
$SO_2$

PROCESS FOR THE GASIFICATION OF COAL

This is a continuation of application Ser. No. 395,087, filed Sept. 7, 1973 and now abandoned.

BACKGROUND OF THE INVENTION

Heretofore, coal has been gasified with stream to make methane, or fuel for power plants, and, in general, the uses of coal gas have paralleled those of natural gas. However, all previous conventional methods have usually generated coal gas by contacting coal with steam or hydrogen at high temperatures and pressures in accordance with the following equations:

$$C(\text{amorph.}) + H_2O(g)\ CO + H_2 + \text{some } CH_4$$

Thereafter, CO is reacted with $H_2$ as follows:

$$CO + 3H_2\ CH_4 + H_2O$$

It has not been possible heretofore to achieve satisfactory rates of reaction when reacting coal with steam at relatively low temperatures, such that coal gasification would be practical at such low temperatures. A significant advantage, however, afforded by the present invention resides in its ability to carry out this reaction at much lower temperatures than had been previously thought possible. Thus, in accordance with the present invention, sulfur dioxide, which is normally considered a pollutant, can be used to promote reaction of steam and coal at significantly lower temperatures.

In the past, gasification of coal has been carried out by the reaction of steam on incandescent coke or coal at temperatures around 1000° C. and higher where the reaction rate and equilibrium have been favorable. By using a higher molar volume ratio of steam relative to coal of 2:1, it has been possible to conduct this reaction at temperatures several hundred degrees lower.

Since the reaction of coal with steam is an endothermic one, which tends to cool off the coal or coke fed into the gasifier, it has been known to use calcium carbonate as a source of $CO_2$ in the gasification process since such use accomplishes the following results: (1) it restores heat to the gasifier in view of the fact that the reaction of coal with $CO_2$ is exothermic; and (2) it generates $CO_2$ which is able to react with the coal to provide carbon monoxide, itself an intermediate in the preparation of methane.

However, it has not been previously possible, under conditions that would justify commercial operation, to conduct coal gasification at temperatures as low as those just upwards of 1200° F., preferably temperatures approximating 1400° F., at atmospheric pressure. By means of the present invention, however, low temperature gasification of coal with steam is now made possible.

SUMMARY OF THE INVENTION

In accordance with illustrative embodiments demonstrating features and advantages of the present invention, there is provided a process for the gasification of coal which comprises contacting a particulate form of coal with steam in the presence of sulfur dioxide. In this manner, reaction of the coal and steam can be effected at much lower temperatures than heretofore had been thought possible, temperatures just upwards of 1200° F., between 1300° F. and 1450° F., and preferably a temperature of about 1400° F. The present invention thereby enables the conversion of coal to a combustible gas, preferably with high B.T.U. content, which can be used as a fuel for power plants, pipeline gas, etc. This process also provides the operator with the option of either conducting the gasification of coal at low temperatures, or of increasing its output capacity or downgrading the size and capacity of his equipment at the same throughput levels.

BRIEF DESCRIPTION OF THE DRAWINGS

The above brief description, as well as further objects, features, and advantages of the present invention will be more fully appreciated by reference to the following detailed description of presently preferred but nonetheless illustrative embodiments in accordance with the present invention, when taken in connection with the accompanying drawing wherein a schematic representation of the present process is given in the form of a block diagram.

DESCRIPTION OF THE PREFERRED EMBODIMENTS

Referring now specifically to the drawing, there is schematically shown a process for the gasification of coal. The coal is introduced into a coal gasifier and the source of coal is a conventional one and can include any of the usual types of carbonaceous materials subjected to gasification such as lignite, sub-bituminous coal, bituminous coal, super-bituminous coal or coke.

Preferably, the coal is in particulate form in a pulverized or crushed state. However, it should be noted that particles that are too fine are not preferred since expensive grinding or milling equipment is required to produce them, and simple crushed bituminous coal is preferable. The particulate or granular coal feed which is used, is introduced continuously into the gasifier, and a suitable source of superheated steam, such as that generated from a boiler or reboiler, is fed therein.

Preferably prior to introduction of the steam into the coal gasifier, an effective amount of sulfur dioxide, is added to the steam, preferably between 0.1 and 20% vol/vol [$SO_2/H_2O(g)$], and the steam-sulfur dioxide admixture is fed into the gasifier.

The reaction is effected at temperatures upwards of 1200° F. such as between 1300° F. and 1450° F., preferably at a temperature approximating 1400° F. Temperatures of upwards of 1200° F. are necessary in order to enable the gasification process to proceed at a satisfactory rate. In general, while theoretically there is no upper limit as to the temperature for gasification, short of pyrolysis, the higher the temperature, the less economical coal gasification processes become. Accordingly, it has been found suitable to operate at temperatures between 1300° and 1450° F. for bituminous coal, preferably at a temperature approximating 1400° F. Suitable pressures approximate atmospheric pressure and the process can also operate at higher pressures, such as to 1000 psi. Suitable amounts of sulfur dioxide include, as indicated, 0.1–20% vol/vol ($SO_2$/steam), preferably 8–10%.

The gas residence time approximates 6 seconds for the following conditions: 1200° F, atmospheric pressure, and 8% $SO_2$. However, at a temperature of 1400° F., 1 atm., and 8% $SO_2$, the gas residence time is 5 seconds.

The $SO_2$ necessary for gasification process is produced in the regeneration portion of the $H_2S$ removal system.

Upon completion of the gasification, the solid residues, i.e., coal ash and non-volatile materials such as tar are removed from the coal gasifier and the effluent gases comprising carbon dioxide, hydrogen, water vapor, carbon dioxide, methane, and hydrogen sulfide are subjected to conventional means for removal of hydrogen sulfide, such as wet or dry scrubbing.

The process stream recycled from the hydrogen sulfide removal step contains sulfur. This sulfur containing effluent, in accordance with the present invention, is converted to sulfur dioxide. Thus, the effluent of the hydrogen sulfide removal step is passed into a sulfur dioxide generator and the sulfur in such effluent is thereby converted to sulfur dioxide. All the other materials that were present in the effluent gases except for hydrogen sulfide are taken off in a product stream, which can be used as fuel for power plants or processed into pipeline gases. In accordance with the foregoing, a quantity of sulfur dioxide, equivalent to the sulfur content of the coal initially fed into the coal gasifier, is removed from the system and the remaining $SO_2$ in the generator is then recycled back into the coal gasifier via introduction into the steam input line thereto.

A latitude of modification, change and substitution is intended in the foregoing disclosure, and in some instances, some features of the invention will be employed without corresponding use of other features. Accordingly, it is appropriate that the appended claims be construed broadly and in a manner consistent with the spirit and scope of the invention herein.

What is claimed is:

1. In a process for the gasification of coal comprising introducing particulate coal and steam into a reaction zone wherein the steam and coal react to form an ash product and a gaseous product the improvement comprising introducing sulfur dioxide into the reaction zone in an amount of from 0.1 to 20% of the volume of said steam, maintaining the reaction zone at a temperature of from 1200° F to 1450° F, removing hydrogen sulfide from said gaseous product, converting the hydrogen sulfide to sulfur dioxide, and recycling at least a portion of said sulfur dioxide to said reaction zone, the amount of sulfur dioxide being sufficient to promote the reaction between the coal and steam, and the temperature being less than that required for the gasification of the coal in the absence of sulfur dioxide.

2. In the process of claim 1 the further improvement comprising maintaining said reaction zone at a temperature from 1300° F to 1450° F.

3. A continuous process for the gasification of coal, comprising:

(a) passing steam and a volume of sulfur dioxide ranging from between 0.1 and 20% of the volume of said steam into a gasifier vessel, said volume of sulfur dioxide being sufficient to promote the reaction between the coal to be gasified and the steam;

(b) continuously supplying particulate coal to said gasifier vessel maintained at a temperature of from 1200°–1450° F whereby the steam reacts with coal to form an ash product and a gaseous product containing hydrogen sulfide, said temperature being less than that required for the gasification of the coal in the absence of sulfur dioxide;

(c) continuously removing the ash product from the gasifier vessel;

(d) withdrawing the gaseous product from the reaction zone and at least substantially removing said hydrogen sulfide; and (e) converting said removed hydrogen sulfide to sulfur dioxide and removing a sulfur dioxide portion equivalent to the sulfur content of the coal from said sulfur dioxide and passing the remaining sulfur dioxide to the gasifier vessel.

4. A continuous process for the gasification of coal according to claim 3, wherein said coal is reacted with said steam at a temperature between 1300° F. and 1450° F. and said sulfur dioxide is injected into the steam before said steam is passed into the gasifier vessel.

* * * * *